US006564867B2

(12) United States Patent
Ohmer

(10) Patent No.: US 6,564,867 B2
(45) Date of Patent: May 20, 2003

(54) METHOD AND APPARATUS FOR CEMENTING BRANCH WELLS FROM A PARENT WELL

(75) Inventor: Herve Ohmer, Houston, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/901,739

(22) Filed: Jul. 10, 2001

(65) Prior Publication Data

US 2002/0020531 A1 Feb. 21, 2002

Related U.S. Application Data

(63) Continuation-in-part of application No. 09/518,365, filed on Mar. 3, 2000, now Pat. No. 6,349,769, and a continuation of application No. 08/898,700, filed on Jul. 24, 1997, now Pat. No. 6,056,059, which is a continuation-in-part of application No. 08/798,591, filed on Feb. 11, 1997, now Pat. No. 5,944,107

(60) Provisional application No. 60/217,366, filed on Jul. 11, 2000, provisional application No. 60/013,327, filed on Mar. 13, 1996, provisional application No. 60/025,033, filed on Aug. 27, 1996, and provisional application No. 60/022,781, filed on Jul. 30, 1996.

(51) Int. Cl.[7] ..... E21B 33/13

(52) U.S. Cl. ..... 166/285; 166/177.4; 166/334.4; 166/50

(58) Field of Search ..... 166/177.4, 334.4, 166/334.3, 332.6, 332.4, 290, 289, 285, 386, 50

(56) References Cited

FOREIGN PATENT DOCUMENTS

| | | |
|---|---|---|
| EP | 0 166 568 A2 | 1/1986 |
| EP | 0 272 080 A2 | 6/1988 |
| EP | 0 823 537 A1 | 2/1998 |
| GB | 2 202 876 A | 10/1988 |

*Primary Examiner*—Hoang Dang
(74) *Attorney, Agent, or Firm*—Williams, Morgan & Amerson, P.C.; Jeffrey E. Griffin; Brigitte L. Jeffery

(57) ABSTRACT

A novel apparatus and method for cementing branch wells from a parent well is disclosed herein. A cementing valve that is releasably coupled to a cementing stringer is used during cementing operations. The cementing valve is comprised of a valve body and a moveable member, each of which have openings formed therein. Movement of the moveable member opens or closes the cementing valve. The method involves releasably attaching the cementing valve to a cementing stinger, running the cementing valve downhole, positioning the cementing valve in a previously open branch outlet, and cementing the branch outlet and branching chamber into position within the well.

12 Claims, 10 Drawing Sheets

METHOD AND APPARATUS FOR CEMENTING BRANCH WELLS FROM A PARENT WELL

CROSS-REFERENCE TO RELATED APPLICATIONS

This application claims priority from provisional patent application Ser. No. 60/217,366, filed Jul. 11, 2000. This application is also a continuation-in-part of application Ser. No. 09/518,365, filed Mar. 3, 2000 (now U.S. Pat. No. 6,349,769), which is a continuation of application Ser. No. 08/898,700, filed Jul. 24, 1997 (now U.S. Pat. No. 6,056,059), which is a continuation-in-part of application Ser. No. 08/798,591, filed Feb. 11, 1997 (now U.S. Pat. No. 5,944,107), which claimed priority from provisional patent application Ser. No. 60/013,327, filed Mar. 11, 1996, and provisional application Ser. No. 60/025,033, filed Aug. 27, 1996. The '700 Application claimed further priority from Provisional Application No. 60/022,781, filed Jul. 30, 1996, the contents of which are hereby incorporated by reference in their entirety.

BACKGROUND OF THE INVENTION

1. Field of the Invention

The present invention is generally related to the field of drilling oil and gas wells, and, more particularly, to a method and apparatus for cementing a branch well from a parent well.

2. Description of the Related Art

There are a variety of techniques for drilling multiple branch wells from a parent well. One technique for drilling such wells is disclosed in U.S. Pat. No. 6,056,059 that issued May 2, 2000, entitled "Apparatus and Method for Establishing Branch Wells From A Patent Well." Generally, that patent discloses a multiple branching sub that includes a branching chamber and a plurality of branching outlets. During the construction of the branching sub, the branching outlets are formed into non-circular shapes such that all of the branching outlets fit within a cylindrical shape that is coaxial with and has substantially the same diameter as the branching chamber. After the branching sub is deployed downhole through the parent casing of the well, an expansion tool is lowered into the interior of the branching sub. The expansion tool is, thereafter, actuated to expand the previously deformed branching outlets into substantially circular outlets.

The next operation to be performed is the cementing of the branching chamber and branching outlets into the well bore. However, given the fact that, prior to expansion, the branch outlets were in a non-circular form, e.g., concave or convex, a traditional float shoe valve could not be positioned within the non-circular, deformed branch outlets prior to the insertion of the branching sub into the well. That is, cementing of the branching chamber and the branching outlets could not be accomplished with a conventional float shoe valve. Thus, there is a need in the industry for a method and apparatus for cementing branch wells from a parent well.

The present invention is directed to a method and apparatus that solves or reduces some or all of the aforementioned problems.

SUMMARY OF THE INVENTION

One embodiment of the present invention is directed to a cementing valve comprised of a valve body and a moveable member, each of which have outlets through which cement can flow. The moveable member is positionable between a first open position and a second closed position where the outlets of the valve body and the moveable member are aligned and not aligned, respectively. At least one of the valve body or the moveable member is adapted for releasable coupling to a cementing stinger.

The cementing valve can further comprise a compression seal pack that is attached to the valve body. A latch can be coupled to one of the valve body or moveable member, the latch adapted for retaining the cementing valve downhole after completion of the cementing operations. One or more collapsible anti-rotation devices can be attached to the cementing valve. The valve body, the moveable member, or both can be adapted for releasable coupling to the cementing stinger. The releasable coupling can be one or more shear elements. The cementing valve can further comprise a retaining latch that, when actuated, secures the moveable valve member in its second, closed position.

The moveable member can be positioned within the valve body and can be adapted for translational or rotational movement relative to the valve body.

Another embodiment of the invention is a cementing valve comprising a valve body having an outlet and a moveable member positioned within the valve body. The moveable member also has an outlet and is positionable to an open position when the moveable member outlet is aligned with the valve body outlet and to a closed position when the moveable member outlet is not aligned with the valve body outlet. Both the valve body and the moveable member are adapted for releasable coupling to a cementing stinger. A latch is coupled to one of the valve body or moveable member and a retaining latch is coupled to the moveable member that, when actuated, secures the moveable member into its closed position. The latch can be adapted for retaining the cementing valve downhole after completion of cementing operations.

The cementing valve can further comprise a compression seal pack that is attached to the valve body. The latch that is coupled to one of the valve body or moveable member is adapted for retaining the cementing valve downhole after completion of the cementing operations. One or more collapsible anti-rotation devices can be attached to the cementing valve. The moveable member can be positioned within the valve body and can be adapted for translational movement relative to the valve body or for rotational movement relative to the valve body.

Yet another embodiment of the present invention is a method for cementing branch wells from a parent well. The method comprises releasably coupling a cementing valve to a cementing stinger, positioning the cementing valve in a branch well outlet and cementing the branch well outlet into position. The method further comprises actuating the cementing valve to a closed position after completion of cementing operations, and decoupling the cementing stinger from the cementing valve.

The act of releasably coupling the cementing valve to a cementing stinger can further comprise positioning the valve to an open position. Positioning the cementing valve in a branch well outlet can further comprise running the cementing valve downhole on the cementing stinger and can include actuating a latch to secure the cementing valve into position so that cementing operations can begin. The step of cementing the branch well outlet into position can further comprise pumping cement through the cementing stinger and the cementing valve to an area adjacent to the branch well outlet.

Actuating the cementing valve to a closed position can comprise positioning the moveable member relative to the valve body. The act of decoupling the cementing valve from the cementing stinger can comprise raising the cementing stinger a first distance to decouple a portion of the cementing valve and raising the cementing stinger a second distance to completely decouple the cementing valve from the cementing stinger.

Still another embodiment of the invention is a method for cementing a branch well that comprises releasably coupling a cementing valve to a cementing stinger, the cementing valve being in an open position, running the cementing valve downhole on the cementing stinger until the cementing valve is positioned within a branch well outlet, and pumping cement through the cementing stinger and the cementing valve into an area adjacent to the branch well outlet. The method further comprises positioning a moveable member of the cementing valve to a closed position and decoupling the cementing stinger from the cementing valve.

The decoupling of the cementing valve from the cementing stinger can comprise raising the cementing stinger a first distance to decouple the cementing stinger from either a valve body or a moveable member of the cementing valve and raising the cementing stinger a second distance to decouple either the valve body or the moveable member that was not decoupled in the movement of the cementing stinger a first distance. The act of running the cementing valve downhole can further comprise actuating a latch to secure the cementing valve into a position whereby cementing operations can begin. Positioning the moveable member of the cementing valve to a closed position can comprise translational movement or rotational movement of the moveable member relative to the valve body of the cementing valve.

BRIEF DESCRIPTION OF THE DRAWINGS

The invention can be understood by reference to the following description taken in conjunction with the accompanying drawings, in which like reference numerals identify like elements, and in which.

Figure 1:
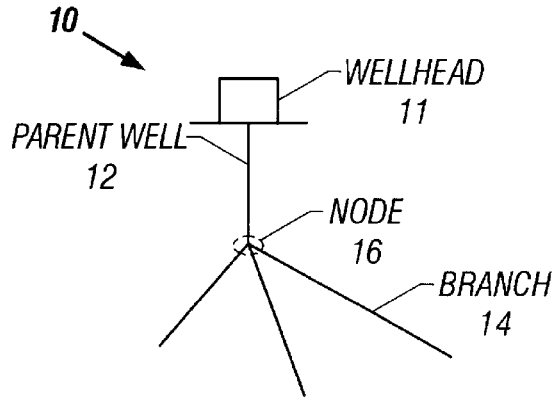
FIG. 1 is an illustrative sketch of a well comprised of a parent well and multiple branch wells.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE INVENTION

Illustrative embodiments of the invention are described below. In the interest of clarity, not all features of an actual implementation are described in this specification. It will of course be appreciated that in the development of any such actual embodiment, numerous implementation-specific decisions must be made to achieve the developers' specific goals, such as compliance with system-related and business-related constraints, which will vary from one implementation to another. Moreover, it will be appreciated that such a development effort might be complex and time-consuming, but would nevertheless be a routine undertaking for those of ordinary skill in the art having the benefit of this disclosure.

Figure 2:
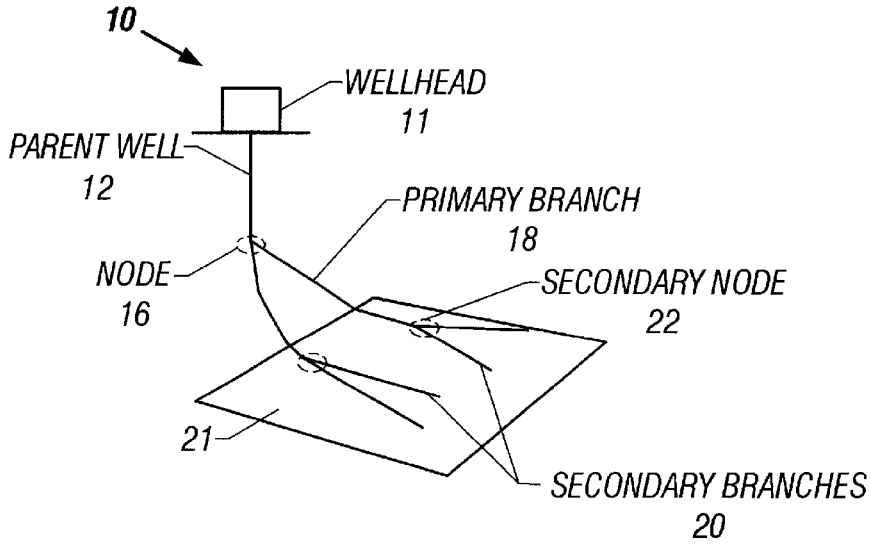
FIG. 2 is an illustrative sketch of a well comprised of a parent well and primary and secondary branch wells for producing hydrocarbons from a single strata.
Figure 3:
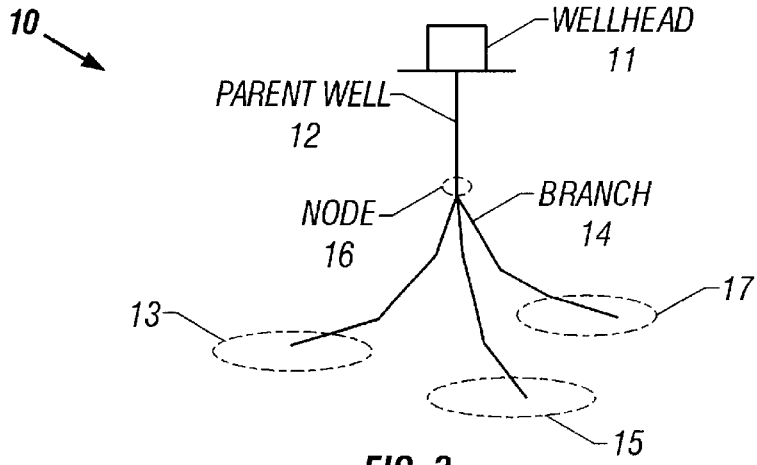
FIG. 3 is an illustrative sketch of a well comprised of a parent well and multiple branch wells for reaching multiple subterranean targets.

FIGS. 1–3 are sketches of illustrative configurations of an oil or gas well 10. For example, a well configured as that shown in FIG. 2 can be used for producing hydro-carbons from a single strata 21. The well configuration shown in FIG. 3 can be used to produce hydrocarbons from multiple subterranean targets 13, 15 and 17.

In general, these types of wells 10 can be comprised of a wellhead 11, a parent well 12, and a plurality of branch wells 14 that can intersect the parent well 12 at a node 16. In certain configurations, for example, the configuration shown in FIG. 2, the branch wells 14 can be further classified as primary branch wells 18 and secondary branch wells 20. Additionally, there can also be one or more secondary nodes 22 formed in the well 10.

The configurations of the oil or gas wells 10 shown in FIGS. 1–3 are illustrative only and do not constitute a limitation of the usefulness of the present invention. In fact, as will be readily recognized by those of ordinary skill in the art, a well 10 can be designed to have any number of branch wells 14, both primary and secondary, and nodes 16, both primary and secondary. The particular configuration of any well 10 will depend upon the desired objectives of the well and the particular field in which it is to be drilled.

A complete, detailed description of one technique for forming branch wells 14 from a parent well 12 is described in U.S. Pat. No. 6,056,059 entitled "Apparatus and Method for Establishing Branch Wells From a Parent Well," that issued May 2, 2000, which is hereby incorporated by reference in its entirety.

Figure 4:
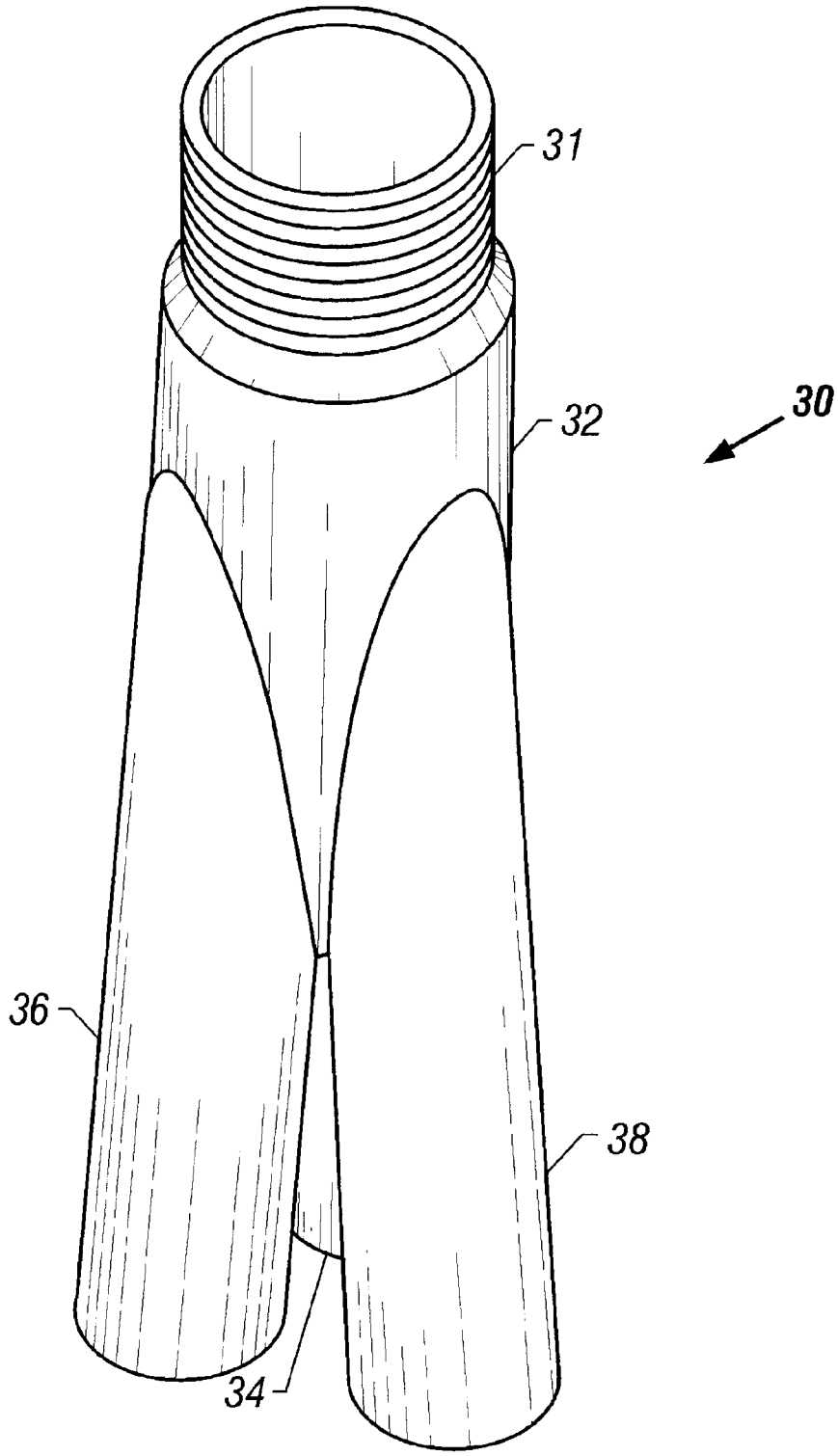
FIG. 4 is a perspective view of a three symmetrical outlet branching sub with its outlet branches expanded.

As shown in FIG. 4, the technique disclosed in the above-referenced patent includes use the of a branching sub 30, which can be comprised of a branching chamber 32, and a plurality of branching outlets 34, 36 and 38, and threads 31 at the top of branching chamber 32 to enable the branching sub 30 to be connected to a parent casing (not shown) for deployment at a subterranean location. In FIG. 4, the branching outlets 34, 36 and 38 are shown in their expanded shape, as they would appear downhole at the end of a parent well 12.

Figure 5A:
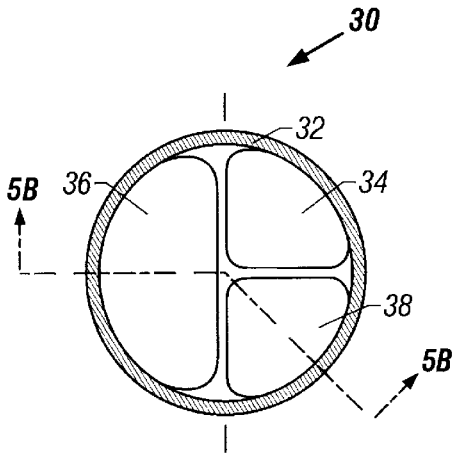
FIG. 5A is an illustrative top cross-sectional sketch of a branching sub with its branching outlets in a deformed configuration.
Figure 5B:
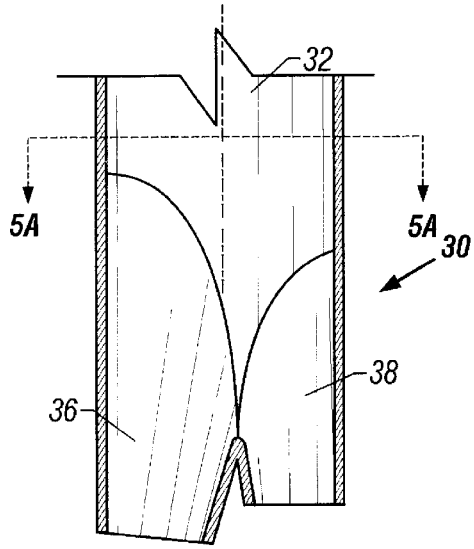
FIG. 5B is an illustrative side cross-sectional sketch of a branching sub with its branching outlets in a deformed configuration.

The branching sub 30 can be of any desired configuration. In one embodiment, as shown in FIGS. 5A–5D, the branching sub 30 is shown with three branching outlets 34, 36 and 38, with the cross-sectional area of the branching outlet 36 being approximately equal to the combined cross-sectional area of the branching outlets 34 and 38. Prior to the insertion of the branching sub 30 into the parent well 12, the branching sub 30 and its branching outlets 34, 36 and 38 can be configured as shown in FIGS. 5A and 5B. In this illustrative embodiment, each of the branching outlets 34, 36 and 38 are deformed inwardly from generally round tubular shapes to the deformed shapes as illustrated in FIGS. 5A and 5B, wherein the configuration of the deformed branching outlets 34, 36 and 38 substantially fill the circular area of the branching chamber 32. Of course, the branching outlets 34, 36 and 38 can be deformed into a variety of shapes, for example, concave or convex, depending upon design considerations.

Figure 5C:
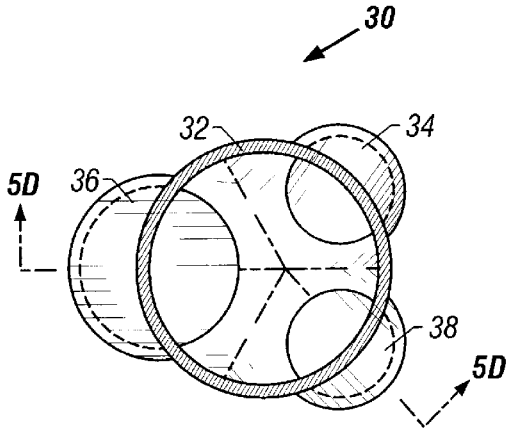
FIG. 5C is an illustrative top cross-sectional sketch of a branching sub with its branching outlets expanded.
Figure 5D:
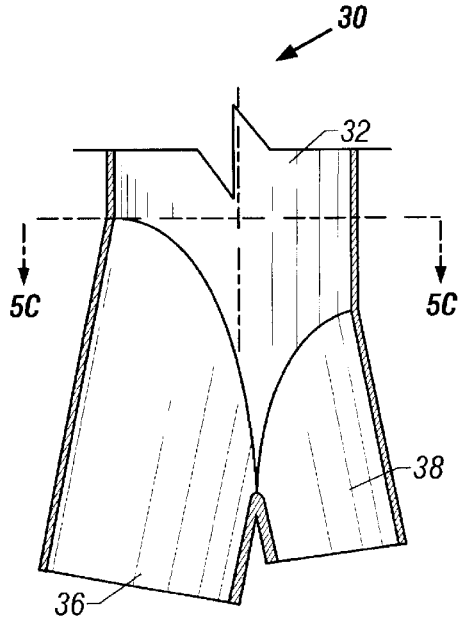
FIG. 5D is an illustrative side cross-sectional sketch of a branching sub with its branching outlets expanded.

FIGS. 5C and 5D illustrate the branching sub 30 after it has been deployed downhole and after the branching outlets 34, 36 and 38 are fully expanded. The branching outlets 34, 36 and 38 are, in one embodiment, expandable to generally round tubular shapes. Note also, as shown in FIGS. 6A–6D, one or more of the branching outlets 34, 36 or 38 can be provided with a closed end 35. Providing a closed end 35 to one or more of the branching outlets 34, 36 or 38 can be beneficial in simplifying subsequent cementing operations (to be described later in more detail). In one embodiment, the closed end 35 can be a metallic cap that is welded to one or more of the branching outlets 34, 36 or 38. In another embodiment, the closed end 35 can comprise an elastomeric element that is attached to one or more of the branching outlets 34, 36 or 38. The elastomeric element would allow some movement of the closed end 35 while the branching outlet is expanded, while retaining a sealed end closure. Of course, the closed end 35 can ultimately be drilled out after cementing operations are completed.

Figure 6B:
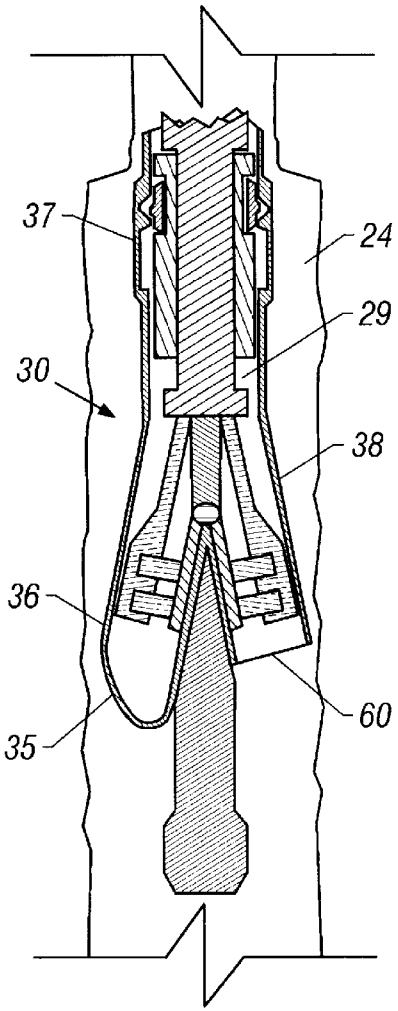
FIG. 6B is a side cross-sectional view showing an expansion tool positioned within a branching sub.

The expansion of branching outlets 34, 36 and 38 from their deformed configurations, as shown in FIGS. 5A and 5B, to their expanded, generally round tubular shapes, as shown in FIGS. 5C and 5D, can be accomplished by use of an expansion tool 29 that is inserted into the branching sub 30 after the branching sub 30 has been run in to the parent well 12 to the desired depth of the node 16. At the time the expansion tool 29 is initially inserted into the branching sub 30, the branching sub 30 is properly positioned in the parent well 12 and the branching outlets 34, 36 and 38 are in their deformed configuration as shown in FIGS. 5A and 5B. Thereafter, as shown in FIG. 6B, the expansion tool 29 is actuated and advanced through the branching sub 30 and into branching outlets 34, 36 and 38 until such time as the branching outlets 34, 36 and 38 are in their expanded, generally round tubular shapes as shown in FIGS. 5C and 5D. One embodiment of an expansion tool 29 for accomplishing this purpose, as well as methods for using such a tool, are disclosed in U.S. Pat. No. 6,056,059 entitled "Apparatus and Method for Establishing Branch Wells From a Parent Well," issued May 2, 2000, which is hereby incorporated by reference in its entirety.

Figure 6A:
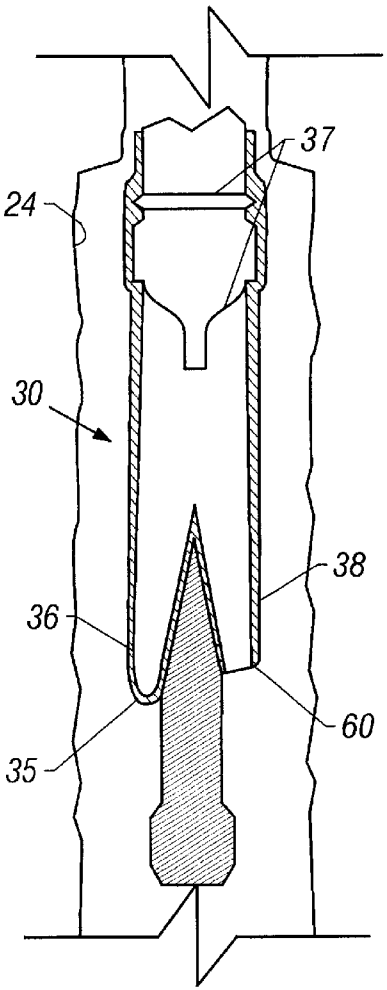
FIG. 6A is a side cross-sectional view of a branching sub positioned within a well with its branching outlets in the collapsed position.
Figure 6D:
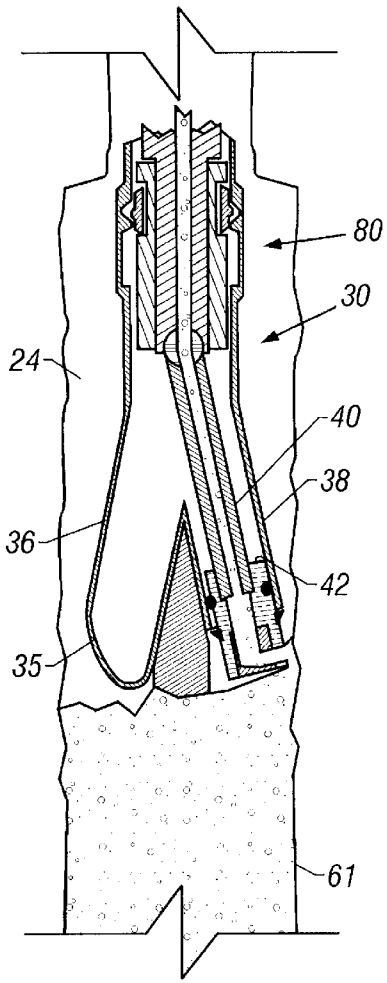
FIGS. 6D and 6E are a front view and side cross-sectional view, respectively, of a cementing valve and cementing stringer positioned within a branching sub and a branching outlet during cementing operations.
Figure 6C:
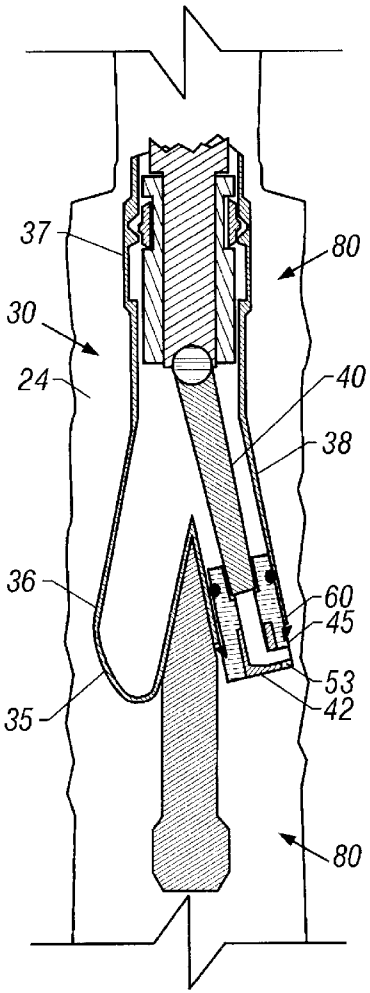
FIG. 6C is a side cross-sectional view of a cementing valve attached to a cementing stinger positioned within a branching sub.

As shown in FIGS. 6A–6C, the branching sub 30 can be provided with landing and orienting means 37 downhole for purposes of landing and orienting the expansion tool 29 (see FIG. 6B) and a cementing stinger 40 (see FIG. 6C). The landing and orienting means 37 is provided to position and orient selected tools at a selected depth within a well casing. One embodiment of such a landing and orienting means 37 is disclosed in U.S. Pat. No. 6,012,527, issued Jan. 11, 2000, entitled "Method and Apparatus for Drilling and Re-Entering Multiple Lateral Branches in a Well," which is hereby incorporated by reference in its entirety. In general, the landing and orienting means 37 disclosed in the above-referenced patent application can comprise a plurality of landing dogs (not shown) having a particular landing profile that is adapted for engagement with a matching landing profile formed in an orienting joint that is part of the well casing. The landing and orienting means 37 can be part of the branching sub 30 or part of a separate orienting joint.

As generally shown in FIGS. 6A–6F, the present invention is directed to a method and apparatus for cementing a branching sub 30 within a wellbore 24. In one embodiment, as shown in FIG. 6C, the cementing operations are accomplished through the use of a cementing valve 42 that is releasably attached to the cementing stinger 40. Before providing a detailed description of the novel cementing method disclosed herein, the cementing valve 42 will first be described in detail.

One illustrative embodiment of the cementing valve 42 is shown in FIGS. 7A–7D. The cementing valve 42 is comprised of a valve body 43 and a moveable member 44. The cementing valve 42 further comprises a valve body outlet 45, a valve body latch 46 positioned within a recess 47, a compression seal pack 48 positioned within a recess 49, and a releasable coupling device 67 for releasably coupling the valve body 43 to a cementing stinger 40. The cementing valve 42 further comprises a seal 51 positioned within a seal recess 52 formed in the moveable member 44, a moveable member outlet 53, a retaining latch 54 positioned within a recess 55, a releasable coupling device 57 for releasably coupling the moveable member 44 to the cementing stinger 40, and at least one collapsible anti-rotation device 56 (only one of which is shown). Also shown is a recess 58 formed in an inner surface 59 of the valve body 43. The recess 58 is adapted for engagement with the retaining latch 54 during use of the cementing valve 42 (as described more fully below).

Although the moveable member 44 shown in FIGS. 7A–7D is adapted for sliding movement relative to the valve body 43, it is readily apparent to those of ordinary skill in the art that there are other configurations of the various parts of the cementing valve 42 that will accomplish the same purpose as the parts shown in FIGS. 7A–7D. For example, the moveable member 44 could be adapted for rotational movement relative to the valve body 43. Thus, the particular components depicted in the figures should not be construed to be a limitation of the present invention.

The general cementing operations will now be described with reference to FIGS. 6A–6E. Initially, as shown in FIG. 6A, a branching sub 30, with its branching outlets 36 and 38 in an at least partially deformed configuration (for example, as shown in FIGS. 5A and 5B) is run downhole. Although the branching sub 30 shown in FIG. 6A is shown with only two branching outlets 36 and 38, it is readily apparent that the number of branching outlets, their size and configuration are illustrative only, and do not constitute a limitation of the present invention.

Next, as shown in FIG. 6B, an expansion tool 29 is run downhole and positioned within the branching sub 30 through use of the landing and orienting device 37. Thereafter, the branching outlets 36 and 38 are expanded to their final, generally circular shape (as, for example, shown in FIGS. 5C and 5D) through use of the expansion tool 29. Note that the branching outlet 36 has a closed end 35, whereas the branching outlet 38 has an open end 60. After expansion of the branching outlets 36 and 38, the expansion tool 29 is then withdrawn from the wellbore 24.

As shown in FIG. 6C, the cementing valve 42 is then releasably coupled to the cementing stinger 40 and run back into the wellbore 24. The cementing valve 42 is properly oriented and positioned within the branching sub 30 through use of the landing and orienting device 37 described in the above-referenced patent. When properly positioned, the cementing valve 42 is in the position shown in FIG. 6C. The landing and orienting device 37 properly positions the cementing valve 42 such that the valve body outlet 45 and the moveable member outlet 53 extend beyond the open end 60 of the branching outlet 38.

Figure 6F:
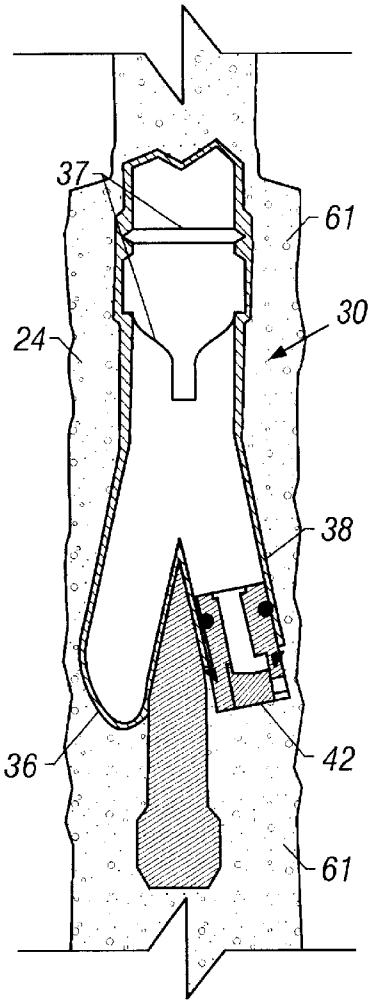
FIG. 6F is a side cross-sectional view of a cementing valve positioned in a branching outlet after cementing operations have been completed.
Figure 6E:
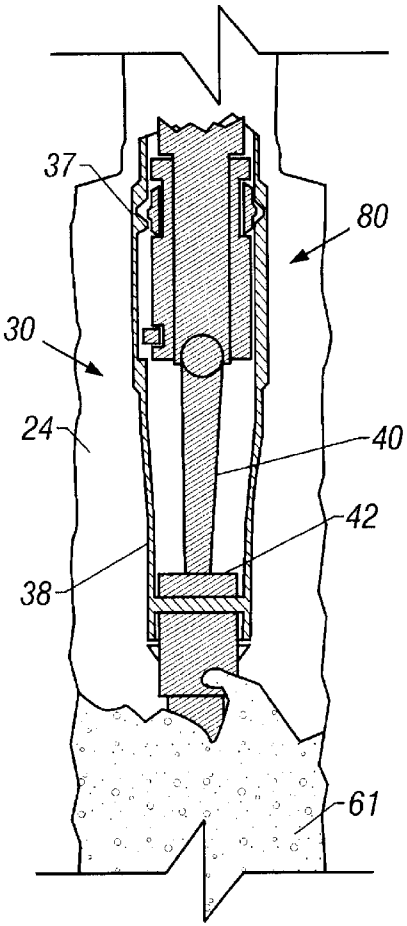

Next, as shown in FIGS. 6D and 6E, cement 61 is injected into the wellbore 24 through the cementing stinger 40 and the cementing valve 42, and begins to displace previously circulated drilling mud and conditioning fluids 80. Cementing operations continue until sufficient cement 61 has been added to cement the branching sub 30 and its branching outlets, for example, branching outlets 36 and 38, into position within the wellbore 24. Thereafter, the cementing valve 42 is closed and decoupled from the cementing stinger 40. The cementing stinger 40 is then withdrawn from the wellbore 24, leaving the cementing valve 42 in the branching outlet 38. This configuration is shown in FIG. 6F.

After the cement 61 has cured, the branch wells 14 (shown in FIG. 1) can be drilled through one or more of the branching outlets 36, 38. Note that the cementing valve 42 is constructed of drillable materials so that it can be drilled out during the drilling of the branch wells 14. Additionally, the closed end 35 of the branching outlet 36 is also made of a drillable material and can be drilled out as necessary to form the branch well 14 through the branching outlet 36.

Figure 7A:
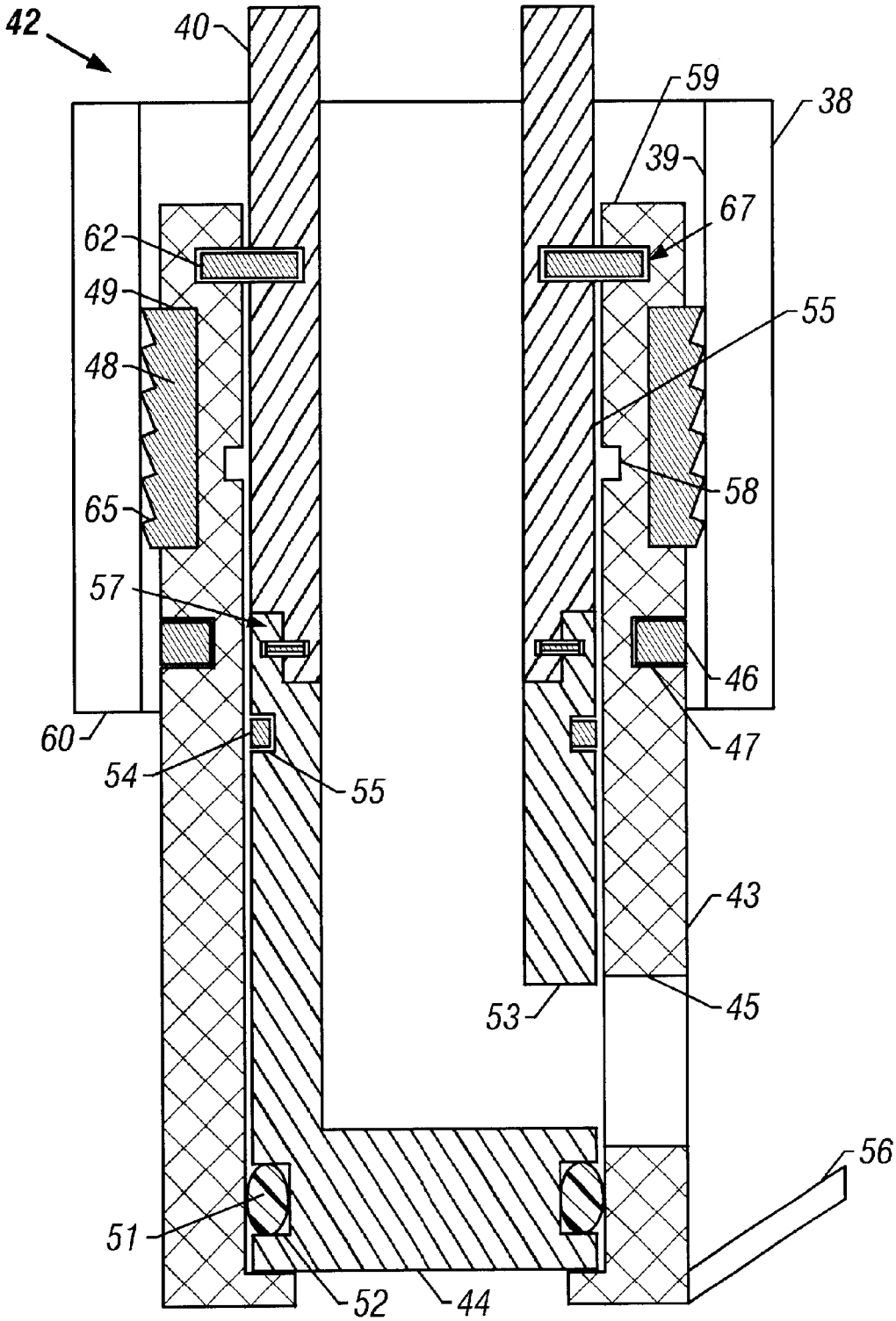
FIG. 7A is a side cross-sectional view of a cementing valve in its open position as it is passing through a branching outlet.

With reference to FIGS. 7A–7D, the operations of the cementing valve 42 will be described in further detail. As shown in FIG. 7A, the cementing valve 42 is shown after it has been releasably coupled to the cementing stinger 40, run downhole, and has passed a portion of the way through the branching outlet 38. The cementing valve 42 is open when it is initially coupled to the cementing stinger 40. That is, the valve body outlet 45 and moveable member outlet 53 are aligned allowing wellbore fluids to enter the cementing stinger 40 and any attached tubulars as the cementing valve 42 is run downhole. This enables pressure equalization between the inside and outside of the cementing stinger 40 and attached tubulars prior to the placing of the cementing valve 42 into the branching outlet 38.

In one embodiment, the valve body 43 can be releasably coupled to the cementing stinger 40 by a plurality of shear pins 62, and the moveable member 44 can be releasably coupled to the cementing stinger 40 by a second set of shear pins 64. Of course, as will be readily recognized by those skilled in the art, any of a variety of techniques or means can be used to releasably couple the cementing valve 42 to the cementing stinger 40. All that is required is that, whatever means is selected, it should be releasable in the sense that after certain downhole operations are performed, the cementing valve 42 can be decoupled from the cementing stinger 40.

As the cementing valve 42 is pushed into the branching outlet 38 by the cementing stinger 40, a plurality of collapsible anti-rotation devices 56 extend to the position shown in FIG. 7A as they pass the open end 60 of the branching outlet 38. (Note that only one anti-rotation device 56 is shown in the figures.) These collapsible anti-rotation devices 56 can be extended by a variety of techniques that are readily known to those of ordinary skill in the art. In one embodiment, the collapsible anti-rotation devices 56 can be spring loaded such that, when the anti-rotation devices 56 are moved beyond the open end 60 of branching outlet 38, the anti-rotation devices 56 spring outwardly to their extended position, as shown in FIG. 7A. When the cementing valve 42 is being inserted into the branching outlet 38, the forward end 65 of the compression seal pack 48 wipes and cleans the inner surface 39 of the branching outlet 38. At this time, drilling mud and conditioning fluid can be circulated through the cementing stinger 40 and the cementing valve 42.

Figure 7B:
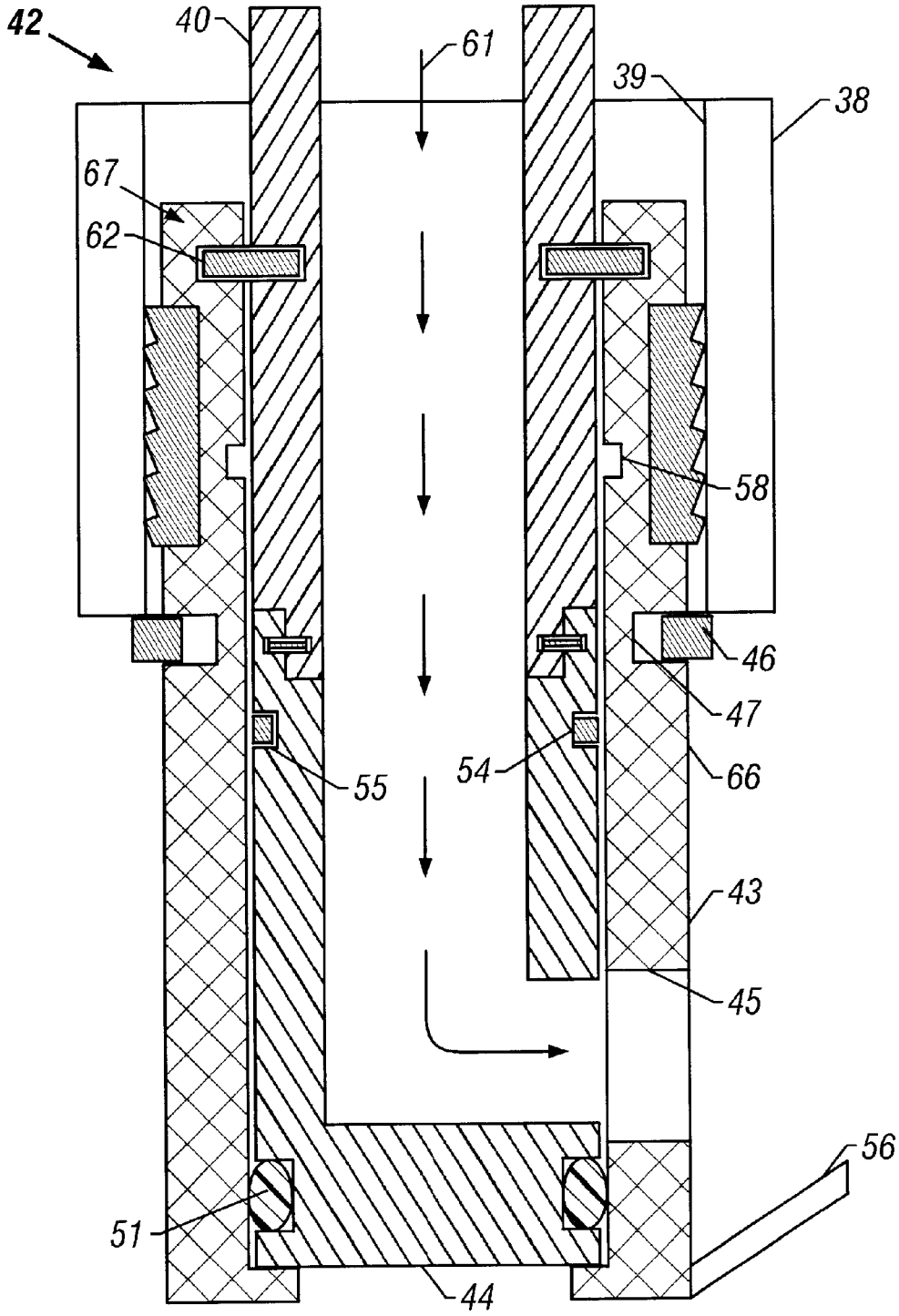
FIG. 7B is a side cross-sectional view of a cementing valve after it is set in the branching outlet and positioned to begin cementing operations.

In FIG. 7B, the cementing valve 42 is shown at its lowermost position in the branching outlet 38. The cementing valve 42 is directed to this position by the landing and orienting device 37 (shown in FIG. 6A) described above. The valve body latch 46 extends to its open position as the valve body latch 46 passes the open end 60 of the branching outlet 38. The movement of the valve body latch 46 to its open position can be accomplished by a variety of techniques. In one embodiment, the valve body latch 46 is spring-loaded into a valve body latch recess 47 formed in the outer surface 66 of the valve body 43.

When the cementing valve 42 is positioned as shown in FIG. 7B, cementing operations can be started as indicated by the arrows 61. The cement is injected into the well through the cementing stinger 40. The valve body latch 46 can engage the open end 60 of the branching outlet 38 during cementing operations, thereby preventing the cementing valve 42 from being forced uphole during cementing operations. The cementing valve 42, due to its position within the well, can slightly divert the flow of the cement 61 laterally so as to induce rotating flow of the cement to improve the consistency of the cement 61. Additionally, during cementing operations, the cementing valve 42 can be rotated through movement of the cementing stinger 40 to help distribute the cement 61 around the branching sub 30 and the branching outlets 36 and 38.

Figure 7C:
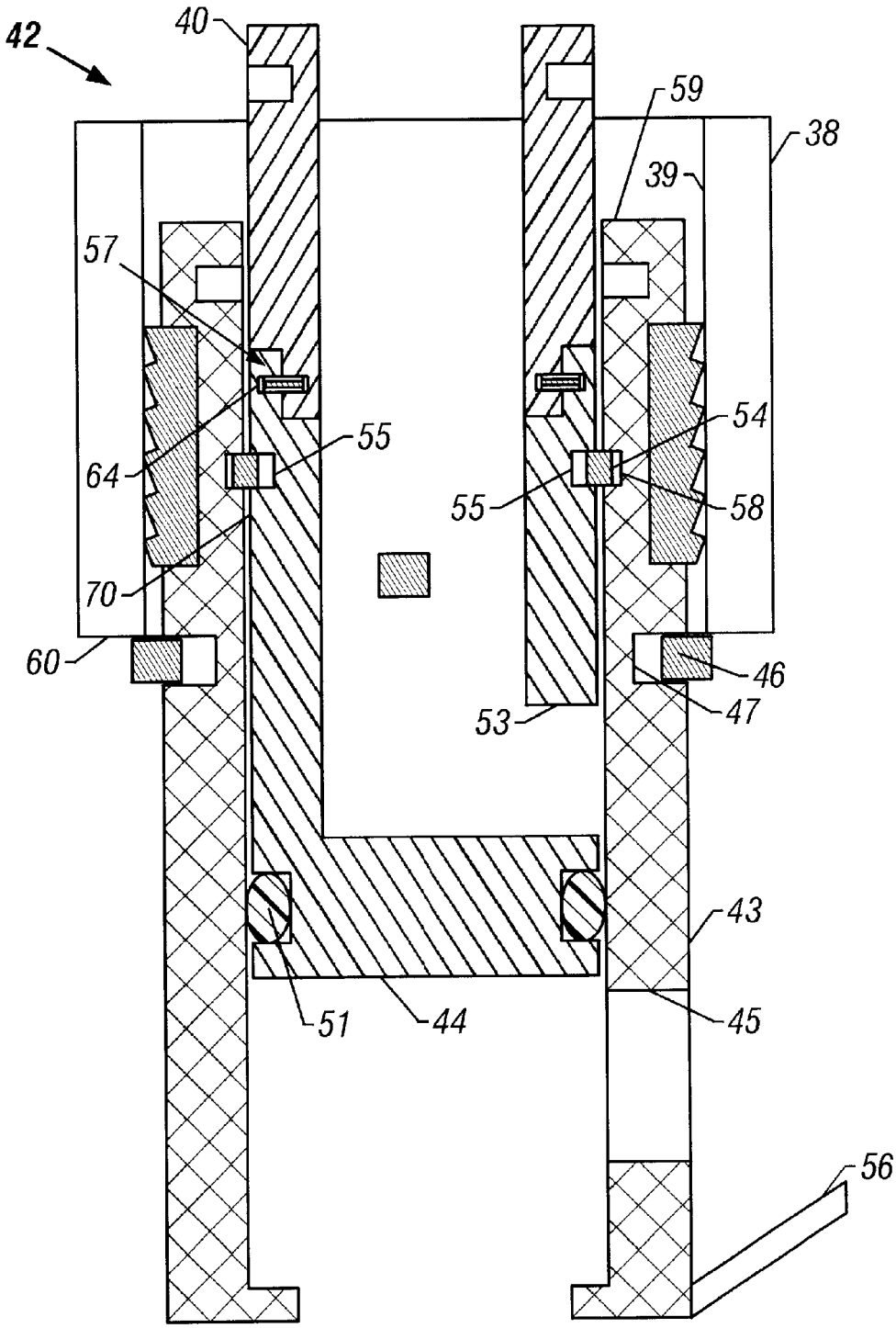
FIG. 7C is a side cross-sectional view of a cementing valve in its closed position.

After a sufficient amount of cement has been injected into the well 10, the cementing valve 42 is actuated to its closed position, as shown in FIG. 7C. In one embodiment, the cementing valve 42 is actuated to its closed position by movement of the cementing stinger 40. The cementing stinger 40 is releasably coupled to the valve body 43 by a releasable coupling device 67, which, in one embodiment, is comprised of at least one shear pin 62. Alternative ways for releasably coupling the valve body 43 to the cementing stinger 40 include collets and other known releasable attachments.

Upward movement of the cementing stinger 40 initially ruptures the shear pins 62 and causes a corresponding upward movement of the moveable member 44 within the valve body 43. The upward movement of the movable member 44 within the valve body can be referred to as translational movement of the movable member 44 relative to the valve body 43. Upward movement of the valve body 43 is prevented by the engagement of the valve body latch 46 with the open end 60 of the branching outlet 38. Continued upward movement of the cementing stinger 40 causes further upward movement of the moveable member 44 until the retaining latch 54 engages the recess 58 formed on the inner surface 59 of the valve body 43. The retaining latch 54 can be actuated by a variety of techniques readily known to those skilled in the art. In one embodiment, the retaining latch 54 is spring loaded into the recess 55 formed in the outer surface 70 of the moveable member 44. When the retaining latch 54 is engaged in the recess 58, as shown in FIG. 7C, the cementing valve 42 is closed. The seal 51 prevents fluid communication with the cement previously deposited around the branching sub 30 and the branching outlets 36 and 38.

An alternate mode of closing the cementing valve 42 is through rotational movement of the moveable member 44 within the valve body 43. The retaining latch 54 and recess 58 can be located in the same radial plane such that when the movable member outlet 53 is no longer aligned with the valve body outlet 45, the retaining latch 54 engages within the recess 56 thus retaining the cementing valve 42 in a closed position. A retaining element such as the shear pin 62 can be used so as to releasably couple the moveable member 44 to the valve body 43 to inhibit rotational movement unto sufficient force is exerted to overcome the retaining element. The anti-rotational device 56 will act to restrict rotational movement of the valve body 43. The seal elements 51 would also have to be located different than as shown in FIGS. 7A–7D so as to effectuate a seal when a rotational rather than translational movement between the moveable member 44 and valve body 43 closes the valve. One sealing method would be a seal element located on the inside of the valve body 43 that encircles the valve body outlet 45 and seals against the moveable member 44 in a manner commonly utilized in ball valves. With this type of seal, fluid can pass through the valve body outlet 45 and the moveable member outlet 53 when they are aligned, but will be isolated from the annulus area between the valve body 43 and the moveable member 44. This type of seal has the additional benefit of reducing the risk of having cement or particulate matter becoming lodged within this annulus area and potentially restricting movement and therefore the working, of the cementing valve 42. When the moveable member 44 is rotated to close the cementing valve 42, a portion of the external surface of the moveable member 44 without an opening would seal against the seal element, thus restricting fluid flow through the valve body opening 45. This is just one example of a sealing means that can be used with rotational movement; other methods are available and are known to those of ordinary skill in the art.

Figure 7D:
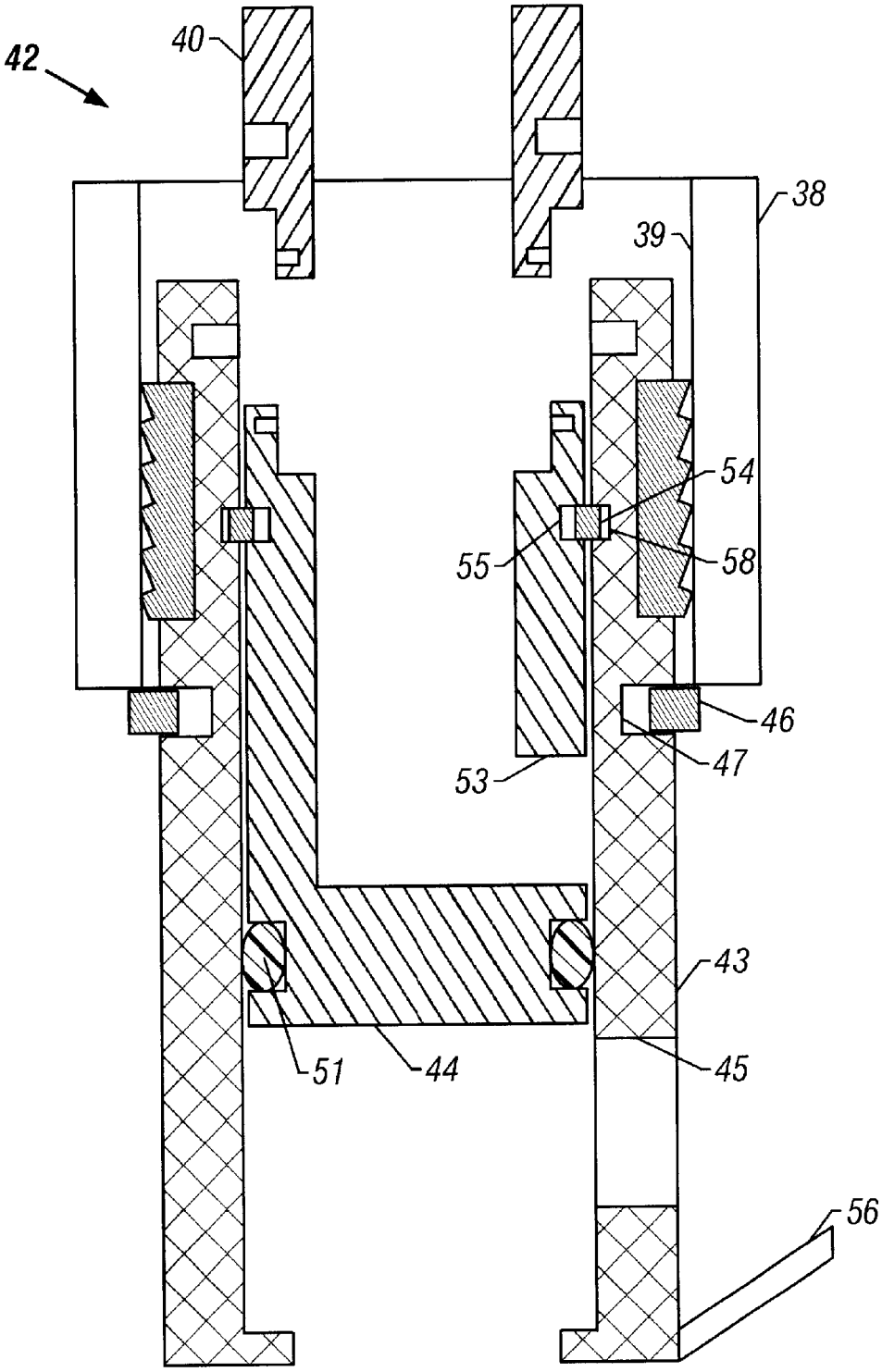
FIG. 7D is a side cross-sectional view of a cementing valve in its closed position and completely decoupled from a cementing stinger after completion of cementing operations.

The next step of the operation, as shown in FIG. 7D, involves decoupling the moveable member 44 from the cementing stinger 40. The moveable member 44 can be releasably coupled to the cementing stinger 40 by a variety of means known to those skilled in the art. In one embodiment, the cementing stinger 40 is releasably coupled to the moveable member 44 with at least one shear pin 64 (shown in FIG. 7C). The shear pins 64 shear or rupture when the cementing stinger 40 is pulled uphole. Upward movement of the moveable member 44 is prevented by the retaining latch 54, which is engaged with the recess 58 formed in the valve body 43. As is readily apparent to those skilled in the art, the shear pins 62 (shown in FIG. 7B) that releasably couple the cementing stinger 40 to the valve body 43 are designed to rupture before the shear pins 64 that releasably couple the moveable member 44 to the cementing stinger 40.

After the cement 61 is allowed to set for a predetermined period of time, the branch wells 14 can be drilled through the branching sub 30 and one or more of its branching outlets 34, 36, 38. Techniques for accomplishing this task are disclosed in the patents referenced above.

The particular embodiments disclosed above are illustrative only, as the invention can be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above can be altered or modified and all such variations are considered within the scope and spirit of the invention. Accordingly, the protection sought herein is as set forth in the claims below.

What is claimed:

1. A method for cementing a branch well, comprising:

releasably coupling a cementing valve to a cementing stinger;

positioning said cementing valve in a branch well outlet, cementing said branch well outlet into position;

actuating said cementing valve to a closed position; and decoupling said cementing stinger from said cementing valve.

2. The method of claim 1, wherein releasably coupling said cementing valve to a cementing stinger further comprises positioning said valve to an open position.

3. The method of claim 1, wherein positioning said cementing valve in a branch well outlet further comprises running said cementing valve downhole on said cementing stinger.

4. The method of claim 1, wherein positioning said cementing valve in a branch well outlet further comprises actuating a latch to secure said cementing valve into position whereby cementing operations can begin.

5. The method of claim 1, wherein cementing said branch well outlet into position further comprises pumping cement through said cementing stinger and said cementing valve to an area adjacent said branch well outlet.

6. The method of claim 1, wherein actuating said cementing valve to a closed position comprises positioning a moveable member of said cementing valve relative to a valve body of said cementing valve.

7. The method of claim 1, wherein decoupling said cementing valve from said cementing stinger comprises:

raising said cementing stinger a first distance to decouple a portion of said cementing valve; and raising said cementing stinger a second distance to completely decouple said cementing valve from said cementing stinger.

8. A method for cementing a branch well, comprising:

releasably coupling a cementing valve to a cementing stinger, said cementing valve being in an open position;

running said cementing valve downhole on said cementing stinger until said cementing valve is positioned within a branch well outlet;

pumping cement through said cementing stinger and said cementing valve into an area adjacent said branch well outlet;

positioning a moveable member of said cementing valve to a closed position; and decoupling said cementing stinger from said cementing valve.

9. The method of claim 8, wherein decoupling said cementing valve from said cementing stinger comprises:

raising said cementing stinger a first distance to decouple said cementing stinger from one of a valve body or a moveable member of said cementing valve; and raising said cementing stinger a second distance to decouple one of said valve body or said moveable member that was not decoupled in the movement of the cementing stinger a first distance.

10. The method of claim 8, wherein running said cementing valve downhole further comprises actuating a latch to secure said cementing valve into position whereby cementing operations can begin.

11. The method of claim 8, wherein positioning said moveable member of said cementing valve to a closed position comprises translational movement of said moveable member of said cementing valve relative to a valve body of said cementing valve.

12. The method of claim 8, wherein positioning said moveable member of said cementing valve to a closed position comprises rotational movement of said moveable member of said cementing valve relative to a valve body of said cementing valve.

* * * * *